US005588663A

United States Patent [19]

Rundle et al.

[11] Patent Number: 5,588,663

[45] Date of Patent: Dec. 31, 1996

[54] WHEELCHAIR TRAY ACCESSORY

[76] Inventors: Christopher Rundle, 12588 SW. 60th Ct., Miami, Fla. 33156; Michael Borell, 7787 SW. 86th St. Apt. 310, Miami, Fla. 33143

[21] Appl. No.: 440,756

[22] Filed: May 15, 1995

[51] Int. Cl.[6] ..... A47B 83/02; A47C 7/68

[52] U.S. Cl. ..... 280/304.1; 108/44; 108/50; 297/155; 297/188.18; 297/188.2

[58] Field of Search ..... 280/304.1; 180/8.1; 312/235.8; 108/42, 44, 46, 50; 297/155, 188.18, 188.2, DIG. 4

[56] References Cited

U.S. PATENT DOCUMENTS

| | | | |
|---|---|---|---|
| 4,223,944 | 9/1980 | DeLong . | |
| 4,373,756 | 2/1983 | Purdy . | |
| 4,428,616 | 1/1984 | Hamilton | 297/155 X |
| 4,526,419 | 7/1985 | Bowman . | |
| 4,730,869 | 3/1988 | Schumacher | 297/188.18 |
| 4,867,506 | 9/1989 | Chavez | 280/304.1 X |
| 4,878,685 | 11/1989 | Bahn . | |
| 5,026,114 | 6/1991 | Miller . | |
| 5,299,824 | 4/1994 | Roberts . | |
| 5,333,929 | 8/1994 | Slagerman | 297/155 |
| 5,356,059 | 10/1994 | Yanez . | |

*Primary Examiner*—Anne Marie Boehler
*Assistant Examiner*—Victor E. Johnson
*Attorney, Agent, or Firm*—McHale & Slavin, P.A.

[57] ABSTRACT

The instant invention is a multi-purpose wheelchair accessory that is secured to a side surface of a conventional wheelchair. The accessory includes a provision for holding personal items in a concealed compartment beneath an extension of an armrest. In addition, a cane is positioned along one end of the accessory allowing the wheelchair operator additional support if needed upon leaving the confines of the wheelchair. A tray table is stored along one side surface of the accessory and includes a hinge allowing the table to be rotated from a storage position into a horizontal plane directly in front of the armrest allowing the person a platform for working and eating. The accessory further extends outward wherein the cane operates as a leg providing an extended handrail in front of the wheelchair allowing the person who leaves the wheelchair a range of support that is not possible from the conventional armrest position. In addition, the apparatus detaches from the wheelchair and includes a curved section which allows the accessory to operate as a ramp. The ramp provides a first level of height which can be doubled by rotating of the cover into a support position.

10 Claims, 5 Drawing Sheets

WHEELCHAIR TRAY ACCESSORY

FIELD OF THE INVENTION

This invention relates to wheelchairs and in particular to a multi-function accessory device that attaches to a conventional wheelchair for use as a storage compartment, tray table, handrail, ramp, and cane all of which benefit individuals who desire increased mobility.

BACKGROUND OF THE INVENTION

Persons with physical impairments have difficulty performing tasks able-bodied persons take for granted such as abutting tables, accessing public facilities, traversing curbs, and so forth. While provisions have been made through legislative measures requiring improved access to public facilities for those physically impaired, access does not always translate to convenient.

Wheelchairs are well known vehicles for the physically impaired and when used properly assist in providing an enhanced standard of living. Wheelchairs may be used by the homebound allowing access throughout the home as well as egress outside the home. Wheelchairs are used in hospitals for patients and are particularly beneficial to the mobility of persons otherwise bedridden. The wheelchair may be used to move patients to other areas of the hospital for tests, examinations, or otherwise assist those patients with limited mobility during a hospital sojourn.

Numerous wheelchair accessories are available to further assist those seated in a wheelchair. The most common accessory is the tray table which allows for eating, writing, and so forth. Prior art patents disclose a number of tray tables and holding compartments beneficial to the wheelchair confined. However, the prior art devices do not provide multiple functions requiring a plurality of components to be coupled to the wheelchair to address critical functions. For instance, U.S. Pat. No. 5,333,929 issued to Slagerman discloses a hinged tray table coupled along a side arm of a wheelchair allowing the table to rotate from a storage position to a working position spanning the level of both armrests. The table panel is stowed in a position along a side of the chair seat beneath an armrest. The tray table has no further functions.

U.S. Pat. 5,299,824 discloses a rotatable tray having a position along the rear of a wheelchair which allows for rotation of the tray to a flat position in front of the wheelchair occupant. When the tray is moved to the back of the wheelchair, the wheelchair occupant is then able to access the seating area uninhabited.

U.S. Pat. No. 5,026,114 issued to Miller discloses a pivotal tray which can be attached to or removed completely from the wheelchair. The tray is attached by means of a vertical rod mounted to the wheelchair leg adapted to receive the rod. Thus, allowing pivotal movement of a tray from a position in front of the wheelchair occupant to a side position allowing the occupant to leave the wheelchair without removing the tray table.

U.S. Pat. No. 4,878,685 issued to Bahm sets forth the prior art trays utilizing a bracket system which attaches to the wheelchair wherein the tray is inserted into the bracket allowing the tray to be placed in front of the occupant of the wheelchair.

U.S. Pat. No. 4,373,756 issued to Purdy, et al. sets forth a wheelchair tray assembly which is slidably attached to the front of the chair using brackets to secure the tray to the arms of the wheelchair. The tray is not storable on the wheelchair and must be removed from the wheelchair arms when not being used, allowing for occupant maneuverability.

U.S. Pat. No. 4,223,994 issued to Delong discloses a retractable tray housed in a roller type mounting bracket beneath one armrest. When removed, the tray is unrolled and attached to the opposite armrest providing a platform for the occupant of the wheelchair.

U.S. Pat. No. 4,526,419 issued to Bowman, et al. sets forth a tray platform having a removable basket underneath the tray. This application defeats the ability to store the tray on the wheelchair.

U.S. Pat. No. 5,356,059 issued to Yanez, et al. discloses a wheelchair basket attachable to a wheelchair. The basket has arms which attach to the back of the chair and legs which rest on the seat or frame. The attachment allows carrying objects in a similar fashion to items carried on a bicycle using a basket but has no provision for use as a tray table.

Thus, what is lacking in the art is a multi-function wheelchair accessory which provides the convenience of a tray table with additional provisions of a handrail, ramp, storage space for concealing personal belongings, as well as a utility tray.

SUMMARY OF THE INVENTION

The instant invention satisfies these needs through a wheelchair accessory having provisions to operate as a storage compartment, tray table, portable and extendable handrails, ramp, and cane.

The apparatus is a compact, lightweight, rectangular shaped hollow housing having one side surface with provisions allowing storage of the housing along a side edge of a conventional wheelchair. A second side surface has a sloped portion allowing the housing to be used as a ramp when detached from the wheelchair. The housing is releaseably secured to the wheelchair by use of a slide rail positioning the housing beneath the wheelchair armrest.

An end of the housing includes a hinged cover allowing access to a cavity formed within the housing. The cavity provides an area for securement of miscellaneous items such as a wallet or purse. Opening of the cover requires the housing to be slid from its storage position beneath the armrest by use of the slide rail to a position allowing uninhibited rotation of the cover. Upon return of the housing to its storage position, the cover cannot be opened as its rotation is inhibited by the armrest.

The housing further operates as an extendable handrail support when the housing is slid forward on the support rail to a position in front of the wheelchair. Full extension of the housing provides nearly three feet of support beyond the armrest allowing an occupant of the wheelchair to stand clear of the seating area yet have a continuous support. A leg is positioned on an end of the housing adding additional stability during full extension. The leg on the end of the housing is adjustable to accommodate uneven floor surface and is removable for use as a retrieval arm or cane.

The extension provides the wheelchair occupant sufficient support when raising from a seated position as well as maneuvering around the handrail to a side of the wheelchair. This extension provides a support when maneuvering around obstacles having inadequate hand support. For example, the extension has found particular benefits for use in accessing public lavatories. Positioning of the wheelchair in front of the lavatory allows placement of the handrail extension into the stall allowing the occupant easier access.

The angular surface of the housing operates as a ramp for moving to a higher surface. In this operation the housing is removed from the slide rail and placed against an object, such as a curb, to be traversed. The wheelchair may then be rolled up or down the sloped surface of the housing as necessary. If the object to be traversed is large, the housing can be reversed rotating the second end cover in an open position and reversing the sloped surface allowing it to abut the ground effectively doubling the angular slope of the ramp. The wheelchair may then be rolled up the backside of the housing to a higher plane. An upper portion of the aforementioned leg can be used to retrieve the ramp without leaving the seat of the wheelchair.

A tray table providing a working surface is hinged to a side surface of the housing allowing storage. The hinge allows the tray to be raised from its storage position by lifting the tray upwardly and then rotating the tray before lowering into a horizontal plane. One end of the table is supported by an opposite side arm of the wheelchair providing additional security and enabling the occupant to perform activities such as eating or writing.

Accordingly, an objective of the instant invention is to provide a multi-function wheelchair accessory for attachment to conventional wheelchairs.

Another objective of the instant invention is to provide a storage compartment that will conceal items therein and further operate as a ramp capable of multiple angular slopes.

Still another objective of the instant invention is to provide a tray table that is foldable into a storage location, the table having a provision for providing a stable platform during use.

Another objective of the instant invention is to provide an extension for the wheelchair providing a handrail support to assist an occupant to rise from a seated position to an upright position for maneuvering to the front or side of the wheelchair.

Still another objective of the instant invention is to provide an adjustable leg for stabilizing the handrail, the leg further operates as a retrieval arm and cane.

Yet still another objective of the instant invention is to provide a portable handrail to supplement the mounted handrail.

Other advantages of our invention will become apparent from the following description taken in conjunction with the accompanying drawings, wherein are set forth by way of illustrative example, along with certain embodiments of the instant invention. The drawings constitute a part of the specification illustrating features thereof.

DETAILED DESCRIPTION OF THE PREFERRED EMBODIMENT

Although the invention will be described in terms of the specific embodiment, it will be readily apparent to those skilled in the art that various modifications, rearrangements and substitutions can be made without departing from the spirit of the invention. The scope of the invention is defined by the claims appended hereto.

Figure 1:
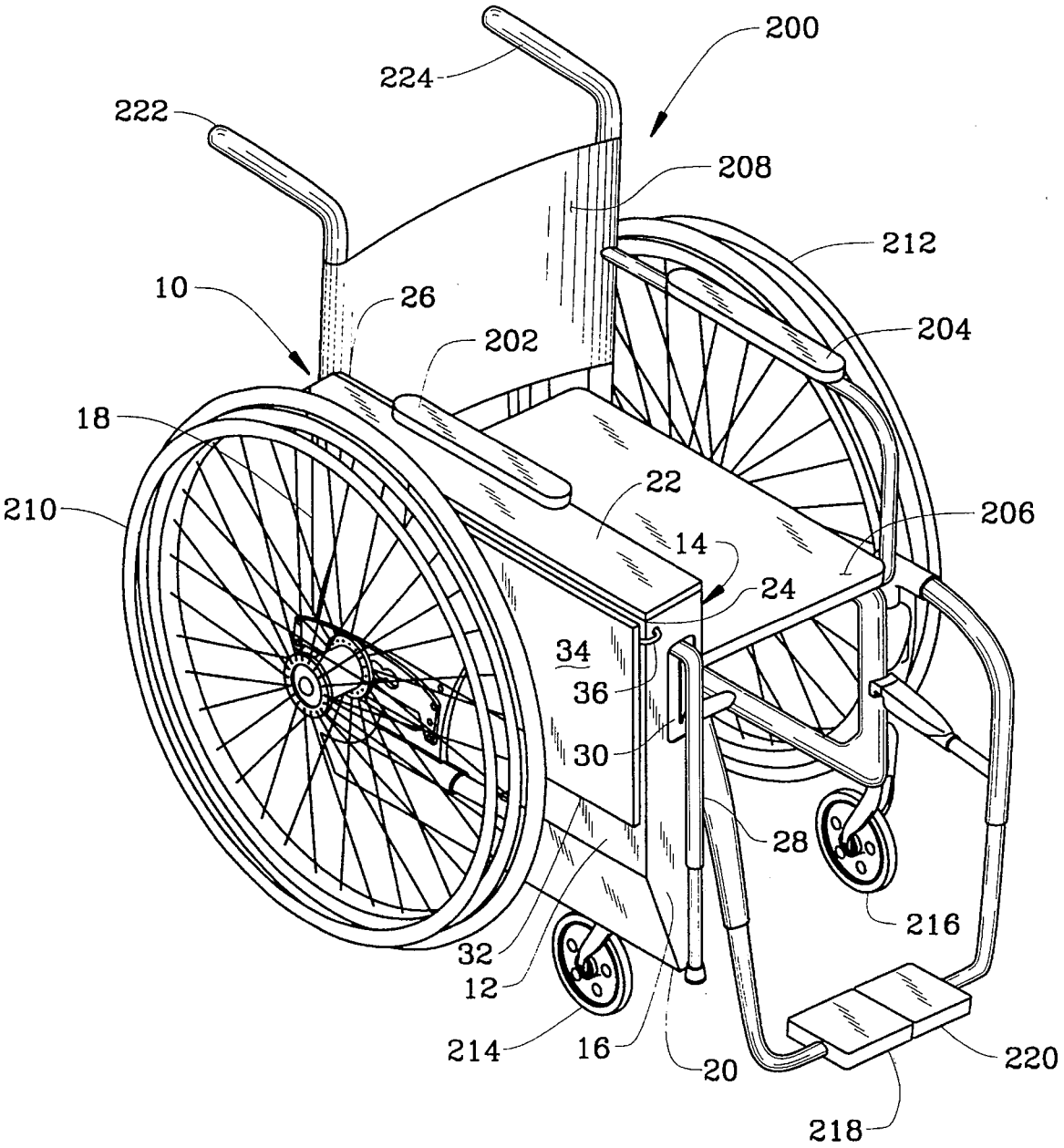
FIG. 1 is a pictorial view of a wheelchair and the multi-purpose accessory installed on the wheelchair.

Referring to FIG. 1, shown is a perspective view of the wheelchair accessory 10 of the instant invention installed upon wheelchair 200. The wheelchair accessory 10 is readily positionable on any wheelchair of conventional design having a frame construction including a first armrest 202 and second armrest 204 shown located over horizontal seat member 206 and directly before vertical back member 208. Pivotable directional wheels 214 and 216, with footrests 218, 220 positioned therebetween, together with enlarged rear wheels 210 and 212 provide for a comfortable mobile chair having both stability and steering control. Push handles 222 and 224 positioned to the rear of the back member 208 permit a person to assist the wheelchair occupant.

The wheelchair accessory 10 is positionable along a side edge of the wheelchair 200 beneath armrest 202 and adjacent an inner portion of rear wheel 210. The accessory 10 is defined by a housing having an upper wall 12 adjoined to a bottom wall 14 by side walls 16 and 18 and a first end wall 20 and second end wall 22. The housing means is a lightweight hollow rigid structure that is constructed of thin wall steel, fiberglass, or reinforced plastic. As described later in this specification the housing is capable of holding the weight of the wheelchair when occupied. For this reason the use of plastic is acceptable if the inner chamber of the housing includes bridge support to prevent the upper and lower wall from collapsing. The second end wall 22 includes a hinge 24 located along a side edge permitting the second end wall 22 to open for access to the chamber. The chamber is suitable for placement of miscellaneous items such as a wallet, magazines, purse, umbrella, lunch, and so forth. It is noted that second end wall 22 has a hinged edge and a free edge 26, when the free edge 26 is positioned beneath armrest 202 preventing it from being rotated into an open position. Thus, when the housing is positioned in a storage position, as shown, the contents within the housing are protected from damage and theft.

Leg 28 is shown on side wall 16 in an upright stored position. Slot 30 allows for raising and lowering of the leg 28 for support of the housing when the housing is not in a storage position. An upper end of the leg 28 is formed perpendicular to the shaft for insertion into slot 30, the slot having an upper section providing support in a hanging position and a lower section wherein the leg presses against the slot providing support for the housing. When the housing is extended, it may be used as a handrail as described later in this specification. It is noted that the leg 28 is removable for use as a cane. A lower portion of the leg includes a means for adjusting the height of the leg providing support on uneven surfaces and, when used as a cane, support for tall persons.

Figure 2:
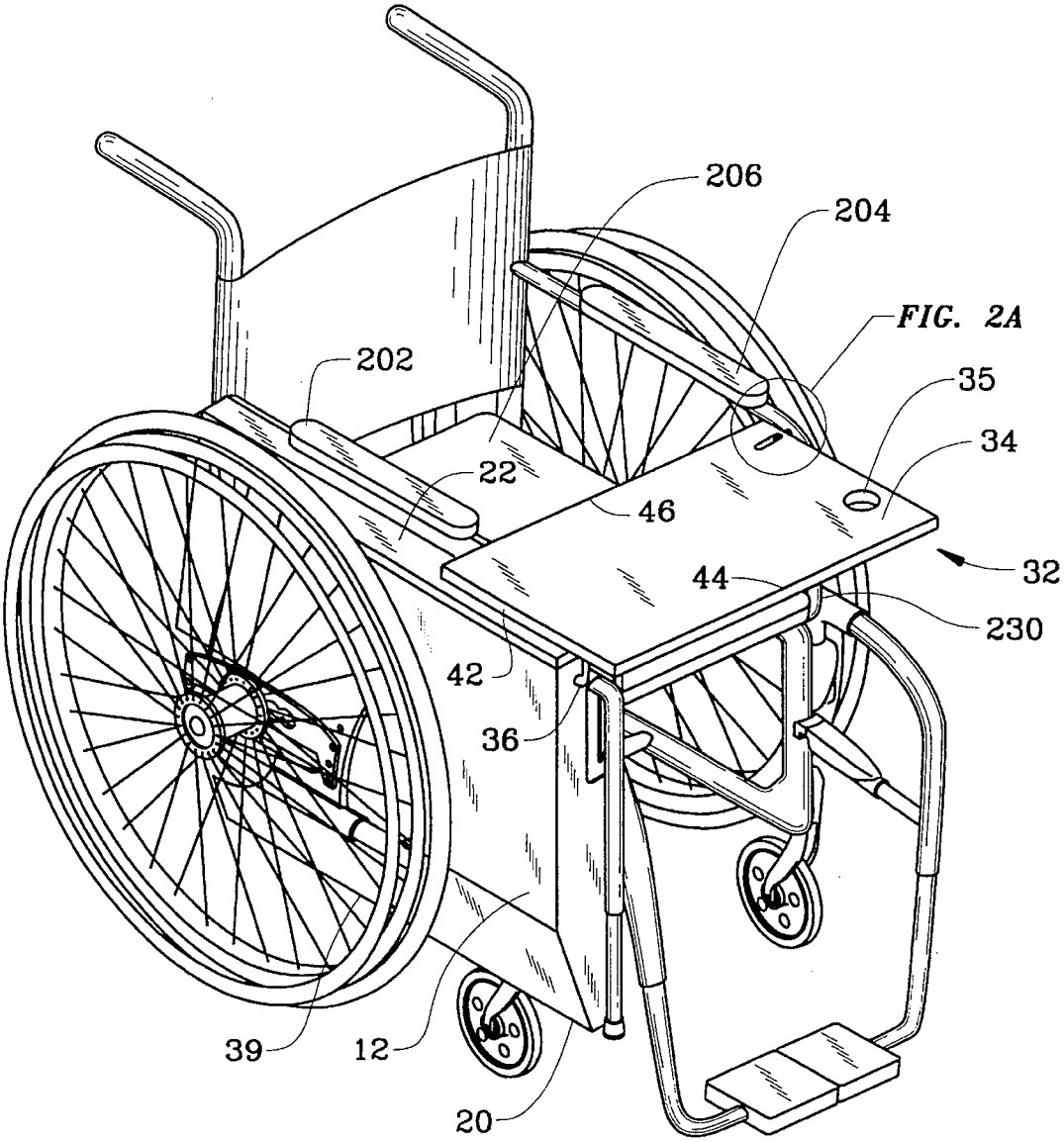
FIG. 2 is a pictorial view of the wheelchair with the accessory forming a tray table.
Figure 2A:
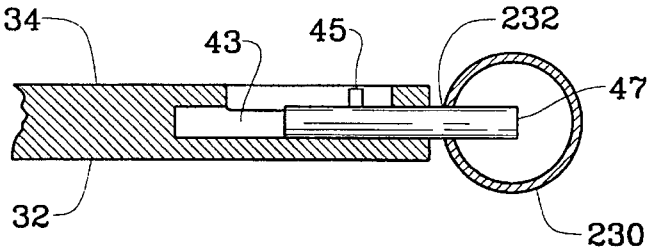
FIG. 2A is a cross sectional side view of the tray table hasp.

A pivotal tray table 32 having a planar surface 34 is coupled to the housing by a second hinge 36 which positions the tray in a storage juxtaposition to the upper wall 12 of the housing and allows for the rotation to a generally horizontal position adjacent to the armrests 202 and 204 as shown in FIGS. 2 and 2A. When placed in a horizontal position the tray 32 spans across the seat member 206 providing a working platform. Aperture means 35 holds the base of umbrellas, flashlights, cups, and the like items having a base designed to fit within the aperture. The items may employ various attachments to hold each item in position and deemed within the scope of this invention.

The tray table 32 includes a hasp 40 which is insertable into a portion of support frame 230 through aperture 232. In this manner, the tray table 32 may be locked into a horizontal plane spanning the armrests 202 and 204 wherein one side edge of the tray table is placed over second end wall 22 providing support along the leading edge 44 and inner edge 46. This will prevent tipping of the tray and items placed thereon. Hinge 36 maintains the tray table 32 in a fixed position in conjunction with hasp 40 which is movable along slot 43 for insertion of pinion through aperture 232. The hasp 40 includes a flush mounted handle 45 providing a smooth surface for placement of items thereon. It should be noted that an ancillary aspect of this invention is to place a hasp 40 into support frame 230 wherein the strap of a purse may be placed around pinion 47 before placement through aperture 232 thereby inhibiting the theft of a purse as the purse is attached to the support post. It has been found that in instances of purse snatching, a purse snatcher simply grabs the purse and runs, wherein the elderly or a handicapped person does not have the facilities to stop the thief. By placement of the strap around the pinion 47 the purse snatcher is confronted with an attached purse and it is predicted that upon the thief's inability to simply grab a purse and run, the thief will drop the purse as it would be too difficult to detach the purse strap before running.

Figure 3:
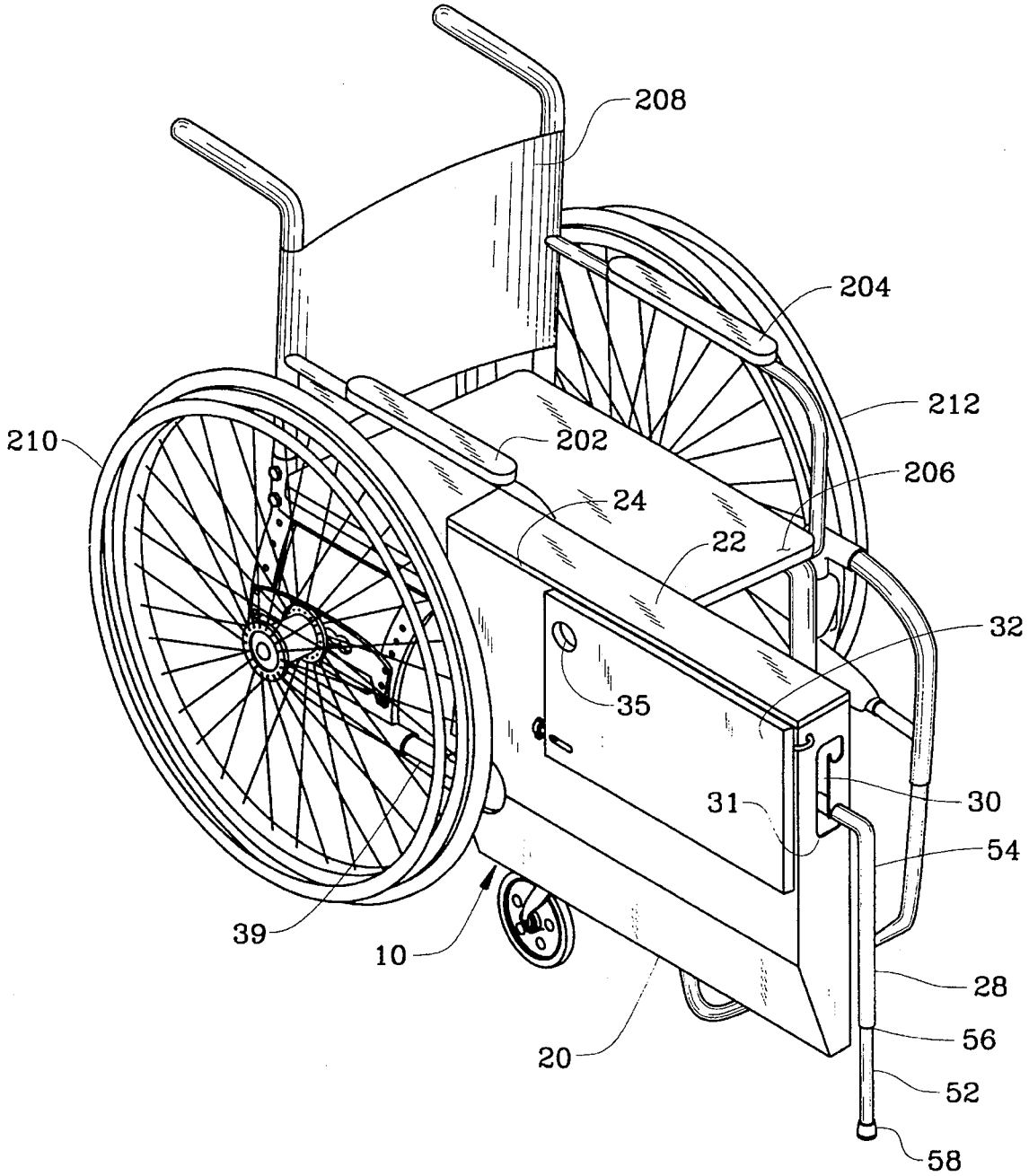
FIG. 3 is a pictorial view of the wheelchair with the accessory performing a handrail.

FIG. 3 sets forth the accessory 10 in an extended position wherein the second end wall 22 operates as a handrail. The handrail effectively extends armrest 202 outwardly from back member 208 allowing the wheelchair bound occupant to stand up by grasping of the second end wall 22 as they position their body away from the seat area 206. For instance, the armrests 202 and 204 are located above the support wheels 210 and 212 allowing a person to raise their self upward by pressing against the armrests. The armrests are placed over the wheels for purposes of support. Should a pressure be applied at an angle the wheelchair may slide from beneath the occupant. The accessory in this position operates to extend the effective length of the armrest. A stable stance is provided by leg 28 which is moved through slot area 30 used to support the leg 28 when not in use to the lower section 31 which engages the upper portion of the leg 28 thus providing support to the housing. The leg has a lower adjustable portion 52 which retracts into the upper portion 54 of the leg allowing the leg to accommodate uneven surfaces. Hasp 56 frictionally engages the lower portion 52 should the preadjusted height provide inadequate support for a particular circumstance. Rubber grommet 58 prevents the leg from moving on polished floor surfaces.

In this embodiment tray table 32 is placed in its storage position along the side surface 24 of the housing. The housing is slid outward from its retracted position along slide rail 39 which assimilates a cabinet drawer slide mechanism. The slide rail 39 allows the housing to slide along the side of the wheelchair from the retracted position, shown in FIGS. 1 and 2, to the extended position shown in FIG. 3. The housing can be removed by over extending the slide rail 39 for other purposes as to be described later in this specification.

With the housing in an extended position, second side wall 22 is beyond the confines of the armrest 202 allowing room for the side wall 22 to rotate along hinge 24 to provide access to the inner chamber of the housing.

Figure 4:
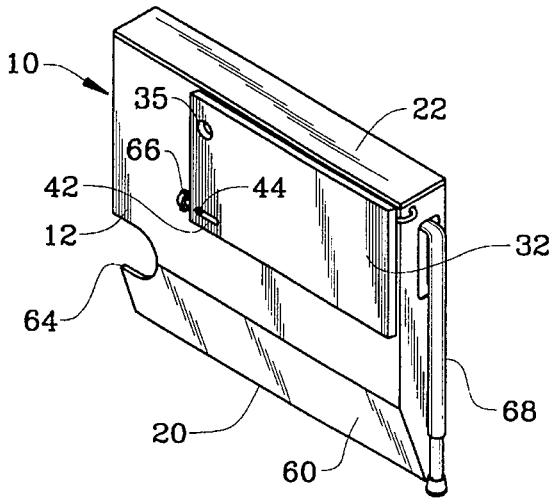
FIG. 4 is a perspective view of the accessory.

FIG. 4 sets forth a perspective of the housing 10 illustrating second end wall 22 in a closed position and tray table 32 in a stored position. Upper side wall 12 includes an angular lower portion 60 that decreases the width of the housing as the sidewall approaches first end wall 20. Cutout 64 provides clearance for the axle of the wheelchair support wheel. Hasp 42 provides support of the tray table 32 while in a storage position with pinion 44 insertable into pinon holder 66. Leg 68 in this embodiment is a single rigid shaft.

Figure 5:
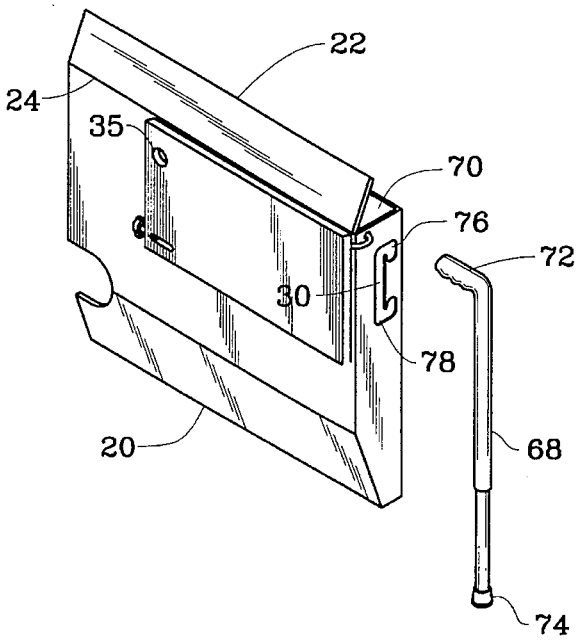
FIG. 5 is a perspective view of the accessory having an upper portion of the armrest opened, revealing a storage container and the leg removed from the accessory to operate as a cane.
Figure 6:
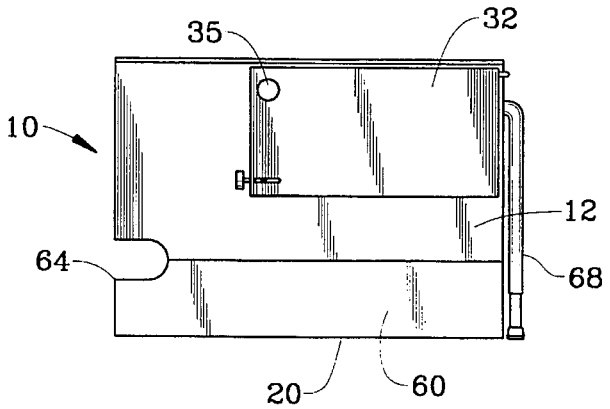
FIG. 6 is a side view of the accessory.

As shown in FIG. 5 second end wall 22 can be raised to reveal compartment 70 by rotating over hinge 24. Leg 68 is shown removed from slot 30 wherein an upper portion 72 has a perpendicular angle to the main portion of the leg allowing for its independent use as a cane. Rubber grommet 74 provides a non-slip surface for use in providing support as a leg or cane. In this illustration, slot 30 clearly depicts an upper section 76 which allows the support of upper portion 72 by simply placing within the slot 30 wherein gravity maintains the leg within the slot. The lower portion 78 has a mirror image slot which allows for engagement on the upper surface of upper portion 72 when the housing is in need of support. A side view of the housing is depicted in FIG. 6 with tray table 32 shown along upper wall 12. Leg 68 is placed in position slightly above bottom surface, or first end wall, 20 to prevent the rubber grommet from dragging beneath the housing. Cutout 64 is positioned at approximately the start of the slope angle for the low surface 60.

Figure 7:
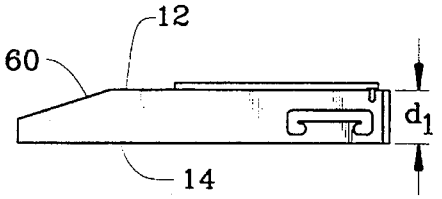
FIG. 7 is an end view of the accessory.

FIG. 7 is an end view illustrating the curvature of lower surface 60 which leads to upper wall 12. By way of illustration the housing operates as a ramp by placement of the lower surface 14 along the ground wherein a wheelchair operator may ride up surface 60 to the elevated upper side wall 12 providing lift of a first height.

Figure 8:
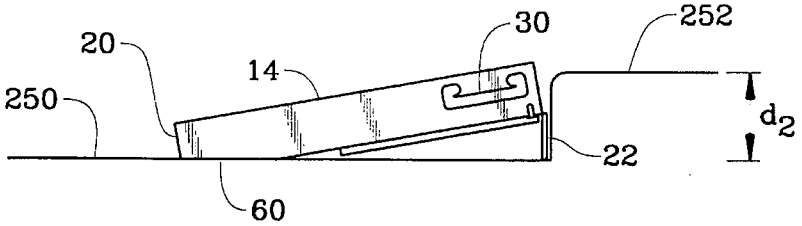
FIG. 8 is an end view of the accessory operating as a ramp with the cover providing a raised height on one side of the accessory.

As shown in FIG. 8, when the accessory is removed from the wheelchair it may be placed upon the ground 250 before curb 252 wherein second end wall 22 is rotated into an open position allowing bottom surface 14 to operate as a ramp allowing the wheelchair to ride up from ground level 250 over the curb 252 to the elevated ground level. As noted, the leg is removed allowing the wheelchair occupant to insert the upper portion of the leg into slot 30 to lift the housing from its position as a ramp allowing the wheelchair bound to return the housing to its storage position. Second side wall 22 is shown in an open, over-center position to provide securement of the housing in a ramp type position along with the frictional engagement of angular surface 60 of upper wall 12 along lower ground level 250. In this manner, the accessory provides two sizes of ramps, one of which raises the wheelchair a distance d1 as shown in FIG. 7 and by rotation of second end wall 22 allows the ramp incline according to distance d2 allowing the wheelchair operator a range of ramp heights in order to address a particular situation.

Figure 9:
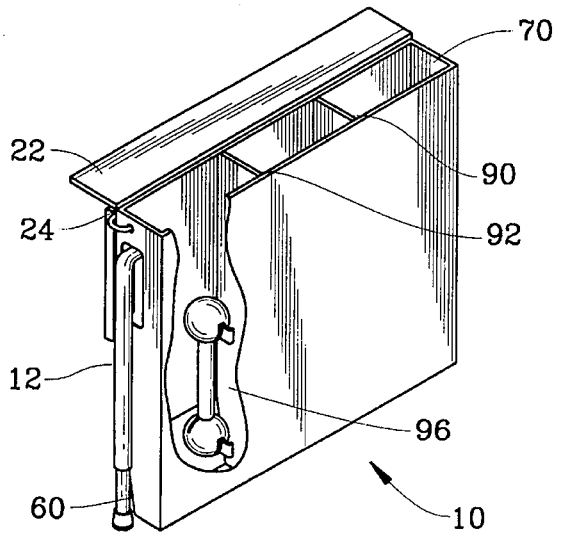
FIG. 9 is a perspective view of the accessory with the side end wall open and a portable handle placed therein.

Now referring to FIG. 9 the housing of the accessory 10 is illustrated with second end wall 22 rotated about hinge 24 into an over-center position. This secures said end wall in a support position allowing the inversion of upper wall 12 for placement against the ground wherein slope 60 is available for resting on the ground together with an edge of the second end wall which operates as the stand. The chamber 70 within the housing include cross-sectional support such as provided by dividers 90 and 92 which are necessary when the housing is made of a light-weight construction such as thermal plastic. In this manner, the housing will not collapse as the dividers act as reinforcement ribs. Chamber 70 allows placement of a number of items such as a portable handrail 96 which fits within one of the chambers formed within cavity 70.

Figure 10:
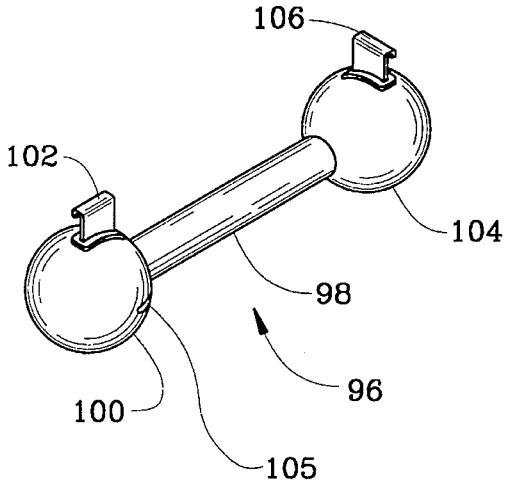
FIG. 10 is a perspective view of the portable handrail.

As shown in FIG. 10, the portable handrail 96 is defined by a dumbbell shaped structure having a narrow cylindrical centrally disposed handgrip portion 98 with an enlarged section 100 on one side matched by an enlarged section 104 on a second side. Each section 100 and 104 can be articulated along slot 105 about a horizontal plane defined by an axis through the center portion 98 of the handrail 96. Each section further includes a flexible extendable band. Hook 102 is placed at one end of the band, shown retracted, located in the first section 100. Hook 106 is placed at one end of the band, shown retracted, located in the second section 104. Each section may be placed in an parallel plane to the handgrip with the inventive aspect directed to the elongated bands. The second section 104 is rotated perpendicular to the first section allowing the hook 106 to grasp places at angular positions to the first section.

Figure 11:
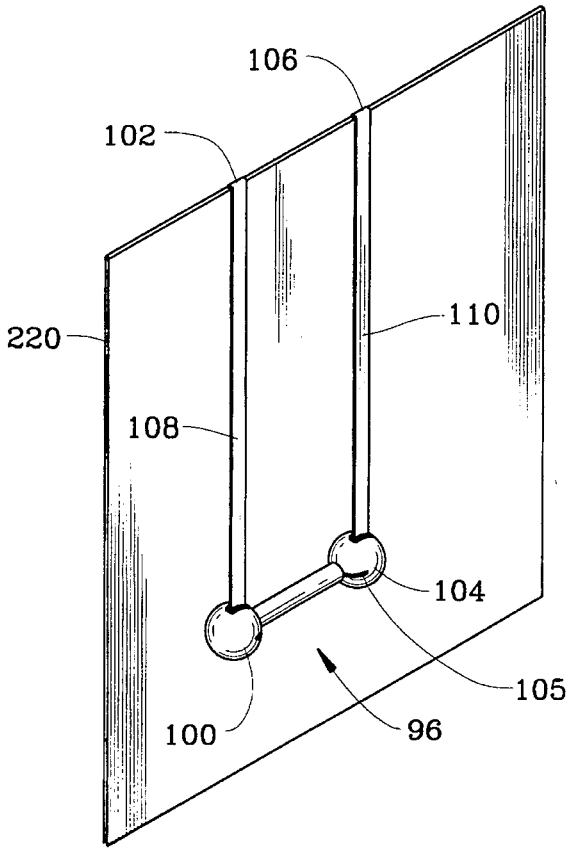
FIG. 11 is a pictorial view of the portable handrail attached to a wall.

Now referring to FIG. 11 the portable handgrip is illustrated with steel band 108 placed in an extended position with hook 102 engaging an upper edge of wall 220. Similarly steel band 110 is placed in an extended position with hook 106 engaging an upper edge of wall 220. Slot 105 is depicted in this illustration with section 104 rotated allowing hooks 102 and 106 to face the same direction. Each said steel band includes a spring means for automatically recoiling each said band into its respective section. The recoil is provided by a side placed spring, not shown, but operates in the same manner as a conventional tape measure. In addition a lock means, also not shown, is available for securing each said steel band in a fixed position allowing the placement of weight onto the portable handrail.

The cylindrical center portion 96 is illustrated in a position against a wall 220 typically of those provided in public facilities wherein the operator may engage hook 102 on an upper edge of the wall 220 by sliding metal band 108 out of housing 100 in a manner similar as that performed with a metal tape measure. The metal band having a counter-flex providing rigidity when in an uncoiled position. Similarly, metal band 110 allows for the raising of hook 106 over upper edge of wall 220 thereby positioning the portable handrail 96 in a position convenient to the operator. In this manner, the portable hand rail 96 allows further extension of slidable handrail allowing the wheelchair occupant to maneuver within enclosed areas where the slidable handrail cannot fully extend.

The portable handrail further allows the wheelchair occupant to retrieve the wheelchair by hooking end 102 or 106 to the wheelchair and allowing metal band 108 or 110 to extend outward wherein the wheelchair occupant may then retrieve the wheelchair by simply pulling on band 108 or 110 when necessary. The portable handrail is also used to lock the chair to a base support which is beneficial for stability in a stall.

It is to be understood that while we have illustrated and described certain forms of our invention, it is not to be limited to the specific forms or arrangements of parts herein described and shown. It will be readily apparent to those skilled in the art that various changes may be made without departing from the scope of the invention and the invention is not to be considered limited to what is shown in the drawings and described in the specification.

What is claimed is:

1. A wheelchair accessory for use in combination with a wheelchair having a frame construction with pivoting front wheels and enlarged rear wheels supporting a horizontal seat member and vertical back member, the wheelchair having spaced apart armrests positioned above an upper surface of the seat member leading to rear push handles disposed behind the vertical back member, said accessory comprising: a detachable housing means having an upper wall adjoined to a bottom wall by two side walls and a first and second end wall defining a chamber therebetween; guide means for securing said housing means to the wheelchair; first hinge means coupled to said second end wall for holding said second end wall in a closed position sealing said chamber, said first end wall having an angular shape, said second end wall rotatable to an over-center open position allowing access to said chamber; a pivotal tray means having a planar surface; a second hinge means coupled to said housing means for holding said tray means in a storage position juxtaposition to said upper wall allowing rotation to a generally horizontal position adjacent to the armrests;

wherein said housing means is slidably secured to said wheelchair positioning a portion of said second end wall beneath a portion of one armrest preventing said second end wall from opening, said housing means slidable to a second position adjacent to the armrest allowing the rotation of said second end wall to said open position allowing access of items placed within the chamber of the housing means whereby the return of the housing means to the first position secures items within the chamber by preventing the opening of said second end wall, said housing means detachable from said wheelchair with the angular shape providing a ramp for rolling said wheelchair onto said housing means providing a ramp.

2. The wheelchair accessory according to claim 1 wherein said pivotal tray includes a means for releasably locking said tray in said storage position and in the horizontal position.

3. The wheelchair accessory according to claim 1 wherein said tray means includes an aperture means.

4. A wheelchair accessory for use in combination with a wheelchair having a frame construction with pivoting front wheels and enlarged rear wheels supporting a horizontal seat member and vertical back member, the wheelchair having spaced apart armrests positioned above an upper surface of the seat member leading to rear push handles disposed behind the vertical back member, said accessory comprising: a housing means having an upper wall adjoined to a bottom wall by two side walls and a first and second end wall defining a chamber therebetween said upper wall of said housing means has a first section disposed in a parallel plane to said lower wall and a second section disposed in an angular plane to said lower wall providing a first ramp angle whereby said housing means is removable from the wheelchair wherein said second section operates as a ramp allowing the wheelchair to be moved between disparate planes across said upper surface, said second end wall including a cover rotatable from a closed position; guide means for securing said housing means to the wheelchair; first hinge means coupled to said second end wall for holding said second end wall in a closed position sealing said chamber, said second end wall rotatable to an over-center open position allowing access to said chamber; a pivotal tray means having a planar surface; a second hinge means coupled to said housing means for holding said tray means in a storage position juxtaposition to said upper wall allowing rotation to a generally horizontal position adjacent to the armrests; leg means securable to one of said side walls of said housing means, said leg means stored in a raised position and positionable in a lower position for use in maintaining said housing in a stable position wherein said housing means may operate as a handrail;

wherein said housing means is slidably secured to said wheelchair positioning a portion of said second end wall beneath a portion of one armrest preventing said second end wall from opening, said housing means slidable to a second position adjacent to the armrest allowing the rotation of said end wall to said open position allowing access within the chamber of the housing means whereby the return of the housing means to the first position closes the chamber by preventing the opening of said second end wall.

5. A wheelchair accessory for use in combination with a wheelchair having a frame construction with pivoting front wheels and enlarged rear wheels supporting a horizontal seat member and vertical back member, the wheelchair having spaced apart armrests positioned above an upper surface of the seat member leading to rear push handles disposed behind the vertical back member, said accessory comprising: a housing means having an upper wall adjoined to a bottom wall by two side walls and a first and second end wall defining a chamber therebetween; guide means for securing said housing means to the wheelchair; first hinge means coupled to said second end wall for holding said second end wall in a closed position sealing said chamber, said second end wall rotatable to an over-center open position allowing access to said chamber; a pivotal tray means having a planar surface; a second hinge means coupled to said housing means for holding said tray means in a storage position juxtaposition to said upper wall allowing rotation to a generally horizontal position adjacent to the armrests;

wherein said housing means is slidably secured to said wheelchair positioning a portion of said second end wall beneath a portion of one armrest preventing said second end wall from opening, said housing means slidable to a second position adjacent to the armrest allowing the rotation of said end wall to said open position allowing access of items placed within the chamber of the housing means whereby the return of the housing means to the first position secures items within the chamber by preventing the opening of said second end wall, and wherein said upper wall of said housing means has a first section disposed in a parallel plane to said lower wall and a second section disposed in an angular plane to said lower wall providing a first ramp angle whereby said housing means is removable from the wheelchair wherein said second section operates as a ramp allowing the wheelchair to be moved between disparate planes across said upper surface.

6. The wheelchair accessory according to claim 5 wherein said second section is adjoined with said second end wall providing a second ramp angle whereby said housing means is removable from the wheelchair and said second section operates as positioned on the ground with said second end wall placed in said open position to operate as a stand providing a ramp allowing the wheelchair to be moved between disparate planes across said lower surface.

7. A wheelchair accessory for use in combination with a wheelchair having a frame construction with pivoting front wheels and enlarged rear wheels supporting a horizontal seat member and vertical back member, the wheelchair having spaced apart armrests positioned above an upper surface of the seat member leading to rear push handles disposed behind the vertical back member, said accessory comprising: a housing means having an upper wall adjoined to a bottom wall by two side walls and a first and second end wall defining a chamber therebetween; guide means for securing said housing means to the wheelchair; first hinge means coupled to said second end wall for holding said second end wall in a closed position sealing said chamber, said second end wall rotatable to an over-center open position allowing access to said chamber; a pivotal tray means having a planar surface; a second hinge means coupled to said housing means for holding said tray means in a storage position juxtaposition to said upper wall allowing rotation to a generally horizontal position adjacent to the armrests; a leg means removably to one of said side walls of said housing means, said leg means stored in an upright position and movable to a lowered position for use in maintaining said housing in a stable position wherein said housing means may operate as a handrail;

wherein said housing means is slidably secured to said wheelchair positioning a portion of said second end wall beneath a portion of one armrest preventing said second end wall from opening, said housing means slidable to a second position adjacent to the armrest allowing the rotation of said end wall to said open position allowing access of items placed within the chamber of the housing means whereby the return of the housing means to the first position secures items within the chamber by preventing the opening of said second end wall.

8. The wheelchair accessory according to claim 7 wherein said leg means is further defined as a cylindrical shaft having a length and a handle portion formed perpendicular to said shaft.

9. The wheelchair accessory according to claim 8 wherein the length of said leg means includes a means for adjusting the length.

10. The wheelchair accessory according to claim 7 wherein said leg means is detachable for use as a cane.

* * * * *